US005327205A

United States Patent [19]

Baba

[11] Patent Number: 5,327,205

[45] Date of Patent: Jul. 5, 1994

[54] AUTOMATIC DOCUMENT FEEDING DEVICE

[75] Inventor: Kenji Baba, Kofu, Japan

[73] Assignee: Nisca Corporation, Yamanashi, Japan

[21] Appl. No.: 60,525

[22] Filed: May 13, 1993

Related U.S. Application Data

[63] Continuation of Ser. No. 729,030, Jul. 12, 1991, Pat. No. 5,280,330.

[30] Foreign Application Priority Data

Jul. 12, 1990 [JP] Japan ..... 2-186005
Jul. 12, 1990 [JP] Japan ..... 2-186006

[51] Int. Cl.[5] ..... G03G 21/00; G03G 15/00

[52] U.S. Cl. ..... 355/311; 355/75; 355/231

[58] Field of Search ..... 355/75, 230, 231, 311; 271/225, 902

[56] References Cited

U.S. PATENT DOCUMENTS 4,659,208 4/1987 Miyazaki et al. ..... 355/311
4,768,068 8/1988 Partilla ..... 355/75
4,825,248 4/1989 Honjo et al. ..... 355/311
4,860,057 8/1989 Saeki et al. ..... 355/75 X
4,922,292 5/1990 Watanabe ..... 355/75
4,972,235 11/1990 Iwamoto et al. ..... 355/311
5,005,055 4/1991 Matsuo et al. ..... 355/311

*Primary Examiner*—Fred L. Braun
*Attorney, Agent, or Firm*—Oblon, Spivak, McClelland, Maier & Neustadt

[57] ABSTRACT

A document feeding device including a compact document feeder unit designed primarily for dealing with document sheets of small or standard size and a platen cover unit is disposed on a platen of a copying machine or the like. A small-size document sheet is fed in the forward direction when being supplied onto and discharged from the platen. In a case of handling a large-size document sheet, the sheet is moved backward after being completely introduced into between the feeder unit and platen so as to enter into between the platen cover unit and the platen, and then discharged by being moved forward after copying. Thus, the large-size document sheet can be dealt with similarly to the small-size document sheet by the document feeder unit made compact.

1 Claim, 6 Drawing Sheets

AUTOMATIC DOCUMENT FEEDING DEVICE

This is a continuation of application Ser. No. 07/729,030, filed on Jul. 12, 1991, now U.S. Pat. No. 5,280,330.

BACKGROUND OF THE INVENTION

1. Field of the Invention

This invention relates to a document feeding device for automatically feeding document sheets one by one to an image reading portion of an image processing system such as a copying machine, and more particularly to an automatic document feeding device capable of automatically feeding large-size document sheets by use of a compact document feeder unit designed for feeding document sheets of relatively small size.

2. Description of the Prior Art

In image processing systems such as copying machines and image scanners, document feeding means of various types are used for feeding document sheets to the image reading portion prescribed in the respective systems. A tendency to employ, as office machines, copying machines capable of dealing with as document sheets large as or larger than A3 size (297 mm×420 mm) is seen lately.

In an ordinary copying machine, a document sheet to be read is fed to a reading portion defined on a transparent platen for copying, and then, discharged from the reading portion after copying by operating a document feeder unit. That is, the document sheet is moved over the platen until the leading end thereof reaches the reference point for image reading (exposure standard point). The document feeder unit for conveying the document sheet generally comprises rotating endless belt means made of flexible material such as rubber lying over the platen.

The platen in the conventional copying machine has the effective copying area equal to or somewhat larger than the document sheet to be dealt with by the copying machine. Therefore, the document feeder unit has a plane area substantially equal to the platen, namely, has had to be made larger than the document sheet to be copied, resulting in a large overall size and heavy weight. Usually, the feeder unit can be opened over the platen so as to manually place the document sheet on the reading portion defined on the platen. However, this would turn out to a troublesome chore.

Furthermore, it is not rational to automatically feed small-size document sheets by using the document feeder unit which is designed for dealing with large-size document sheets. In general, a document sheet of relatively small size (e.g. A4 size and ledger size) is very frequently utilized. The conventional document feeder unit has suffered a disadvantage that the small-size document sheet is dealt with similarly to the document sheet of large size (e.g. A3 size). It therefore would be i deal that a compact document feeder unit which is designed primarily for automatically feeding small-size document sheets can take care of the large-size document sheets.

For the purpose of rationally dealing with document sheets of different sizes, there have been proposed document feeding devices in U.S. Pat. No. 4,922,292 (corresp. to Japanese Patent Appln. Public Discl. HEI 2(1990)-13532(A)), and Japanese Patent Appln. Public Disclosures HEI 2(1990)-13534(A) and HEI 2(1990)-13579(A). These conventional document feeding devices all have a semi-automatic document feeder which can automatically feed only document sheets of relatively small size (e.g. A4 size). That is, though the aforementioned conventional document feeder makes it possible to automatically feed the small-size document sheet to a prescribed location in a copying machine or the like, document sheets of large size (e.g. A3 size) cannot be automatically fed and therefore must be manually positioned at the prescribed location by opening the the document feeder. The conventional document feeder can avoid the increase in size, but not satisfy the requirements for full automation and rationality of feeding document sheets of different sizes in a copying machine and so on.

OBJECT OF THE INVENTION

This invention was made in consideration of the aforenoted drawbacks of the conventional document feeding devices. Its object is to provide a full-automatic document feeding device capable of automatically feeding large-size document sheets as well as standard small-size document sheets to a prescribed location in an image processing machine such as a copying machine by use of a document feeder unit designed primarily for dealing with the small-size document sheets.

Another object of this invention is to provide an automatic document feeding device capable of automatically recognizing the size of a document sheet being fed to the prescribed location in the image processing machine and automatically conveying the document sheets of different sizes to the prescribed location with high efficiency.

Still another object of this invention is to provide an automatic document feeding device which is made compact and can be manually opened with ease so as to enable a document sheet to be manually positioned at the prescribed location in the image processing machine.

Yet another object of this invention is to provide an automatic document feeding device capable of automatically turning upside down the document sheet to be positioned at the prescribed location so as to effect automatic double-side reading such as duplex copying.

SUMMARY OF THE INVENTION

To attain the objects described above according to the present invention there is provided an automatic document feeding device for feeding document sheets one by one onto a transparent platen in an image processing machine, which comprises a document feeder unit covering half or less a document reading area defined on the platen so as to convey the document sheet along between the feeder unit and the platen, and a platen cover unit having a document guide pad covering the remaining document reading area except the area covered with the document feeder unit.

The document feeder unit has a document entrance at the end portion adjacent to the platen cover unit, and a document exit at the other end portion. On the document entrance, there is disposed a document supply means having a document supply passage through which document sheets are introduced one by one into a document processing passage formed between the document feeder unit and the platen.

In a case of feeding a document sheet of standard small-size, the document sheet is introduced into the document processing passage on the platen and fed along the platen until the leading end of the document sheet reaches the reference point defined in the document reading area on the platen. After reading the image on the document sheet, the document sheet is fed out from the reading area by driving the document feeder unit.

When handling a document sheet larger in size than the aforesaid standard small-size document sheet, the document sheet is forwarded and introduced completely into the document processing passage between the document feeder unit and the platen. Then, the document sheet is moved backward by reversing the document feeder unit to enter into between the platen and the document guide pad of the platen cover unit until the leading end of the document sheet is aligned to the reading reference point on the platen. After the document sheet is subjected to image reading, the document sheet is fed forward and discharged from the reading area by driving forward the document feeder unit.

By opening the document feeder unit over the platen, the standard small-size document sheet can be manually positioned on the platen, and by further opening the platen cover unit, the large-size document sheet can be similarly positioned thereon.

The document sheet after being copied and fed out from the document processing passage prescribed on the platen is effectively discharged to a document output tray by driving a document discharging roller. Otherwise, by allowing the document sheet once being fed out from the document processing passage to advance around the discharging roller, it can be turned upside down and re-enter into the document processing passage for the purpose of duplex copying and so on.

BRIEF DESCRIPTION OF THE DRAWINGS

The other objects and features of the present invention will be hereinafter explained in detail with reference to the accompanying drawings, wherein.

Figure 3:
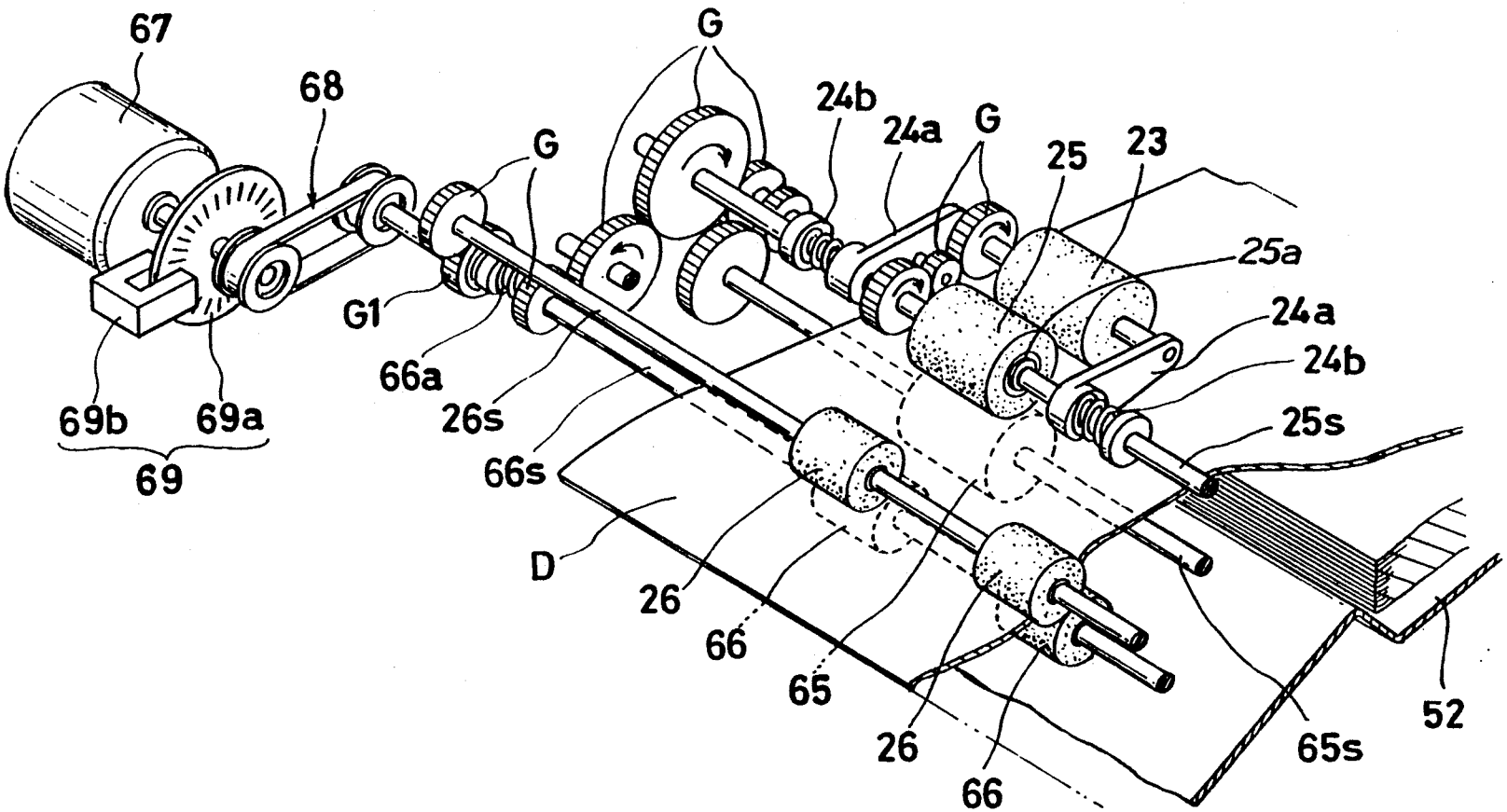
Figure 4A:
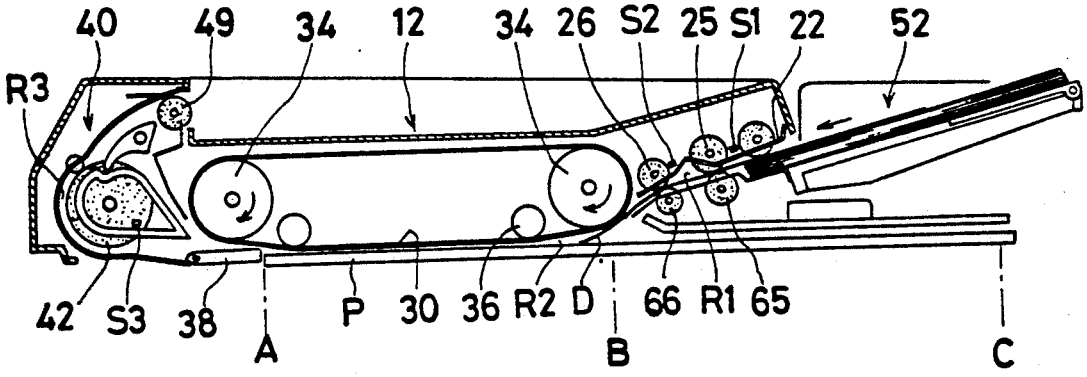
Figure 4B:
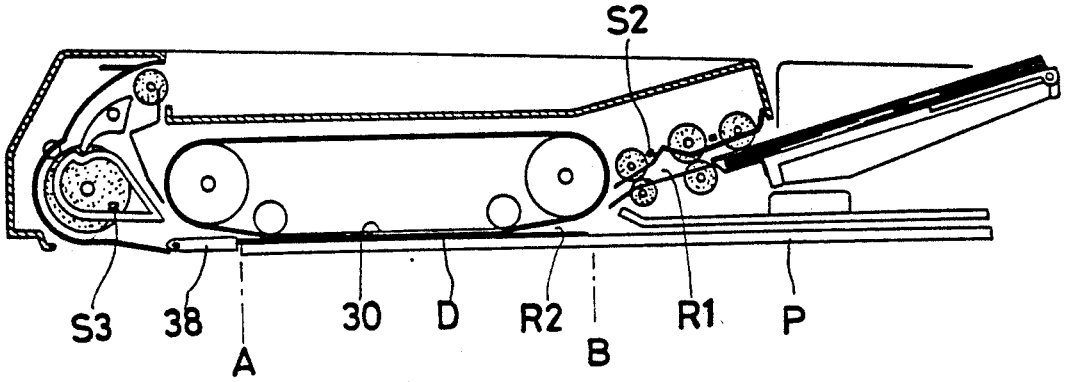
Figure 4C:
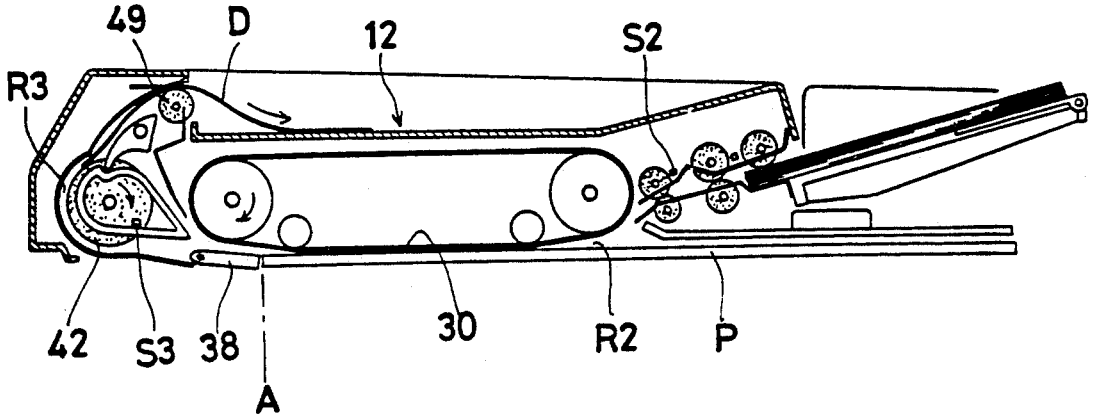
Figure 5A:
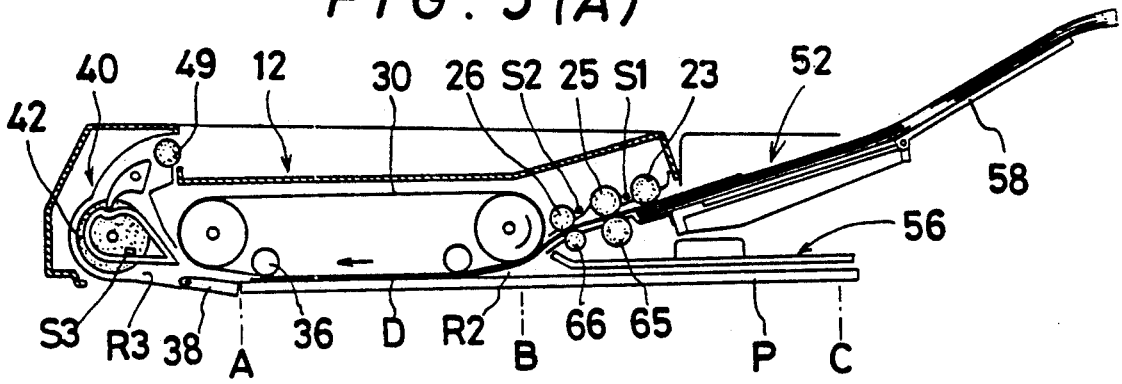
Figure 5B:
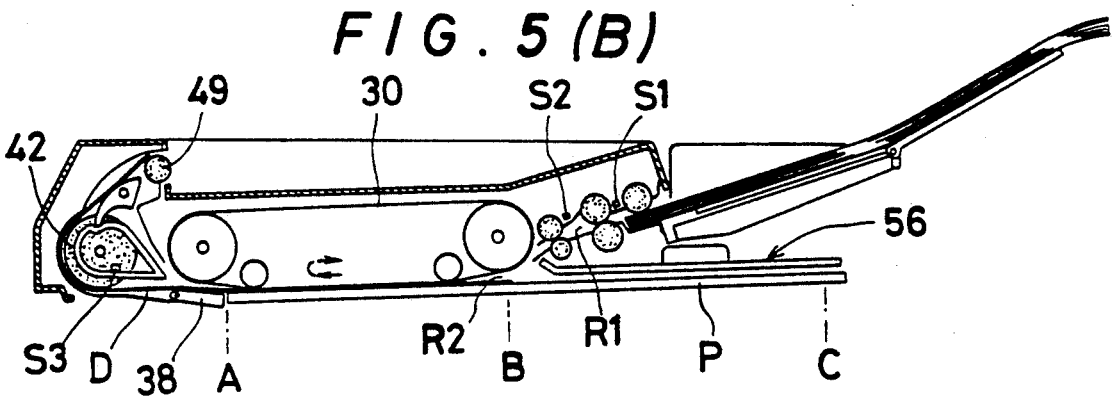
Figure 5C:
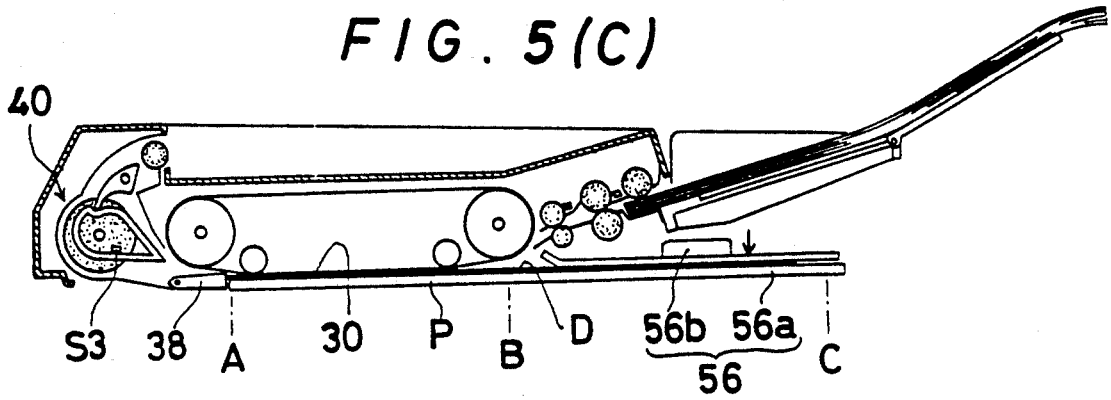
Figure 5D:
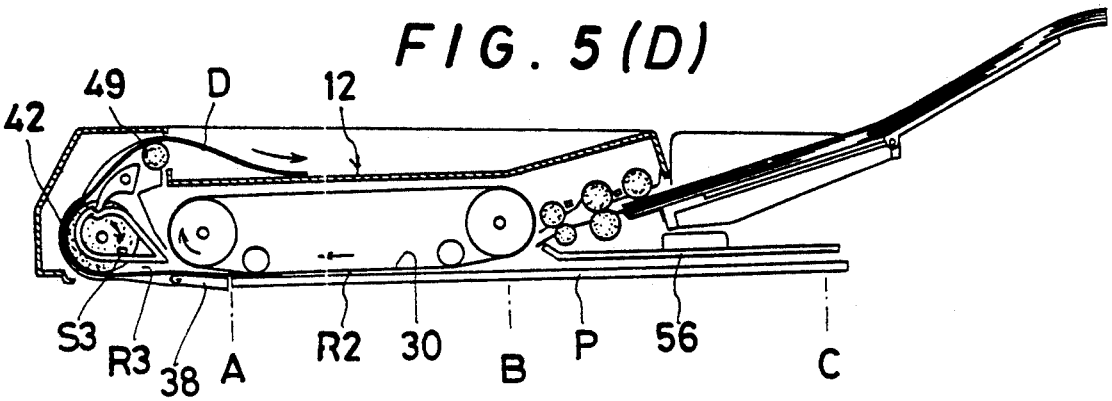
Figure 6:
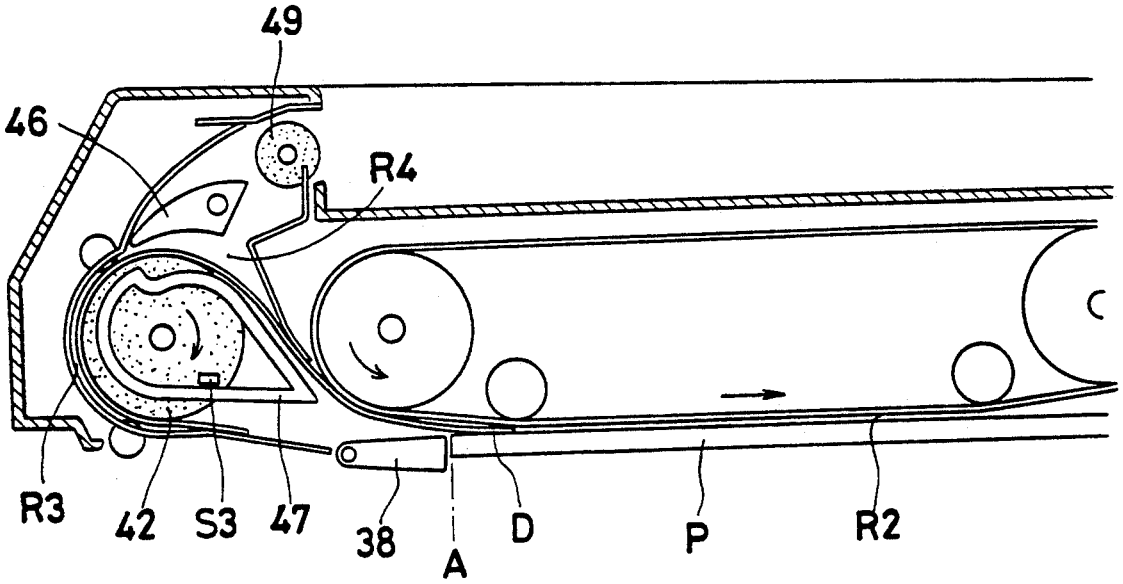

FIG, 2 is a side sectional view showing the device of FIG, 1;

FIG. 3 is a perspective view showing the document supply means in the device of this invention;

FIGS. 4(A) through 4(C) are explanatory views showing the sequence in which a small-size document sheet is fed;

FIGS. 5(A) through 5(D) are explanatory views showing the sequence in which a large-size document sheet is fed; and FIG. 6 is an explanatory view showing a function of reversing the document sheet.

DESCRIPTION OF THE PREFERRED EMBODIMENTS

The automatic document feeding device according to this invention has a function of automatically feeding document sheets of relatively large longitudinal size one by one by use of a compact document feeder unit designed primarily for dealing with document sheets of small or standard longitudinal size. This document feeding device will be described with reference to FIG. 1 and FIG. 2.

Figure 1:
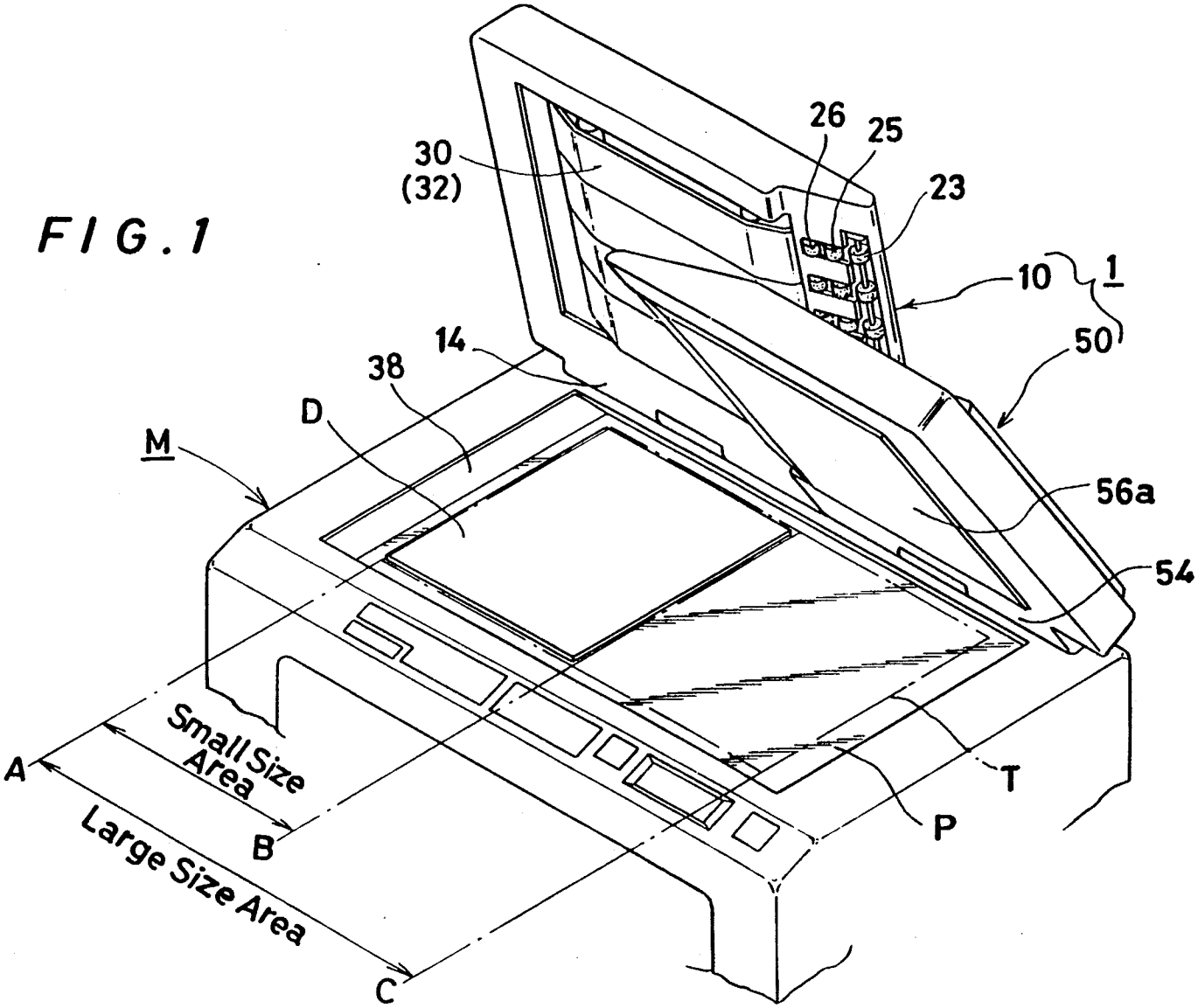
FIG. 1 is a perspective view showing one embodiment of the automatic document feeding device according to this invention, which is applied to a copying machine as one example.

In FIG. 1, a copying machine M is shown as one example of an image processing machine to which the automatic document feeding device of this invention is applied. The copying machine M generally comprises a transparent platen P on which an effective copying area (reading area T having a length from point A to point C) is defined. The point A at one end of the reading area T is determined as an image reading reference point (exposure standard point). In copying operation, a given document sheet D is positioned in the reading area T, aligning the leading end of the document sheet D with the reference point A, so that a desired copied matter having an image corresponding to that on the document sheet D can be obtained.

The reading area T between A-C prescribed as the maximum document size is equivalent to a large size, for example, A3 size (297 mm×420 mm) which would be usually used infrequently. Therefore, the half area between A-B is for a small or standard size, for example, A4 size (210 mm×297 mm), ledger or letter size, which would be mainly used. That is to say, the area A-C is designated for a large-size document sheet, and the area A-B is for a small-size document sheet. In FIG. 1, the small-size document sheet is positioned in the small-size area, aligning the leading end of the sheet with the reference point A.

Over the platen P (reading area T), there is mounted the automatic document feeding device 1 of this invention.

The document feeding device 1 comprises a document feeder unit 10 having a document output tray 12, and a platen cover unit 50 having a document supply tray 52. In this embodiment, the document feeder unit 10 covers substantially half the maximum document size area T on the platen, namely, the small-size area A-B including the reference point A at the leading end portion relative to the document feeding direction, and is fixed onto the copying machine M through hinge means 14 to be openable over the platen P as shown in FIG. 1. The platen cover unit 50 covers the remaining area B-C except the area covered with the document feeder unit 10, and is fixed onto the copying machine M through hinge means 54 to be openable over the platen P.

When the document feeder unit 10 and platen cover unit 50 are adjoined in the horizontal state on the platen P, the document feeder unit 10 is partially overlaid on the platen cover unit 50 to thereby form a document supply passage R1 therebetween with a slant. In the state covering the platen with the feeder unit 10 and cover unit 50, the document feeder unit 10 can be independently opened over the platen. However, when the platen cover unit 50 is lifted in that state, the document feeder unit 10 is also opened over the platen together with the platen cover unit 50.

The document supply passage R1 is defined by guide plates 22, 62 which are retained in the feeder unit 10 and the cover unit 50, respectively. The document supply means arranged along the document supply passage R1 comprises document pickup rollers 23 disposed near the entrance portion of the document supply passage R1 in the state movably toward the document supply tray 52, sets of contacted document supply rollers 25 and separation rollers 65, and paired skew correction rollers 26, 66 being in contact with each counterparts near the exit portion of the document supply passage R1. The exit of the document supply passage R1 is confronted with the point B nearly at the center of the reading area T defined on the platen P. The aforenoted rollers 23, 25, 26, 66 forming the document supply passage R1 are arranged so as to rotate at the regular peripheral speed by means of a rotation source 67 such as a pulse motor, belt driving means 68 and gears G as shown in FIG. 3.

The document pickup rollers 23 are supported by rocking arm members 24*a* which are pivoted on rotating shafts 25*s* on which the document supply rollers 25 are fixed through spring clutches 24*b*. When one document sheet D is drawn from a stack of document sheets on the document supply tray 52 and introduced into the document supply passage R1, the rollers 23, 25, 26, 66 are concurrently rotated in the direction indicated by the arrows in FIG. 3 by the rotation source 67. At this time, the rotating document pickup rollers 23 move downward about the shaft 25*s* and then touch the uppermost document sheet of the stacked sheets on the tray 52 with a moderate contacting force, because the downward movement to be imparted to the pickup rollers 23 is transmitted to the pickup rollers through the spring clutches 24*b*. When the rotating pickup rollers ,23 come into contact with the uppermost document sheet D, the document sheet D is forced into the document supply passage R1.

The document supply rollers 25 incorporate one-way clutches 25*a* so that, even when the shaft 25*s* stops rotating, the rollers 25 are idled by forcibly advancing the document sheet D. The first-stage gear G1 fixed on a shaft 66*s* is provided with a one-way clutch so as to be idled when the rollers 23, 25 are rotated forward, to thereby prevent transmission of rotation from the rotation source 67 to the skew correction rollers 26. On the shaft 66*s*, there is disposed a spring clutch 66*a* through which the rotation is transmitted to the shaft 25*s* retaining the document supply rollers 25.

With the aforenoted document supply means, when the rotation source 67 is driven forward, only the document supply rollers 25 and document pickup rollers 23 rotate in the forward direction (document feeding direction). When the rotation source 67 is reversed, only the skew correction rollers 26, 66 rotate in the forward direction. Thus, the document sheets D stacked on the document supply tray 52 are drawn one by one and fed through the document supply passage R1.

The separation rollers 65 are driven synchronously with the document supply rollers 25 to rotate in the same direction with that of the document supply rollers 25. The separation roller 65 has frictional coefficient somewhat smaller than that of the document supply roller 25. That is, the separation rollers 65 rotate in the backward direction opposite to the document feeding direction so as to prevent two or more document sheets from passing through between the contacted document supply rollers 25 and separation rollers 65.

On the output shaft of the rotation source 67, there is mounted a timing pulse generating means 69 which comprises a disk-shaped optical interrupter 69*a* having radial slits which is fixed on the output shaft of the rotation source 67, and a photosensor 69*b* which generates timing pulses responsive to light passing through the slits formed in the interrupter 69*a*, when rotation source 67 is operated.

The document supply passage R1 communicates at the point B with a document processing passage R2 formed between the platen P and the document feeder unit 10. To be more specific, the document feeder unit 10 has document conveying means 30 comprising an endless belt means 32 made of flexible material such as rubber, pulleys 34, 35 for rotatably supporting the endless belt means 32, and press rollers 36 for pressing the endless belt means 32 against the platen P.

By operating the document conveying means 30, the document sheet D which is fed out from the document supply passage R1 and introduced to the reading area T on the platen P can be advanced to the reference point A or further forward to be discharged, or moved in the reverse direction. Nearby the reference point A, a document stopper 38 is disposed and operated by a solenoid 39 so as to selectively check the advance of the document sheet D to be read on the platen P.

The document feeder unit 10 includes a document discharge means 40 having a document discharge passage R3 which is connected at the reference point A to the document processing passage R2. That is to say, the discharge passage R3 extends from the reference point A to a document exit at which exit rollers 49 are disposed. The document discharge means 40 comprises a document discharge roller 42 having a relatively large diameter. The discharge passage R3 is partially formed between the outer peripheral surface of the discharge roller 42 and a guide plate 43. Along the discharge passage R3, there are arranged guide rollers 44 coming into contact with the discharge roller 42.

In a regular case, the document sheet D fed from the document processing passage R2 is sent out to the document outlet tray 12 on the document feeder unit 10 through the document discharge passage R3 by rotating the discharge roller 42. However, this embodiment has a function of circulating the document sheet D through a return passage R4 formed partially around the discharge roller 42 to turn the document sheet D upside down and again introduce it into the document processing passage R2 on the platen. Such a document turning mechanism is composed of a turn gate 46 which is selectively turned to a document discharging state or a document returning state, a turn guide member 47, and a guide plate 48 for defining the turn passage R4 in conjunction with the guide member 47 around the discharge roller 42. The turn gate 46 in FIG. 2 assumes the document discharging state.

The driving pulley 35, discharge roller 42 and exit rollers 49 are concurrently rotated at the fixed peripheral speed by a single driving means (not shown) such as an electric motor so that the document sheet D can be advanced along the discharge passage R3 at the same speed as that at which the document sheet is fed along the passages R1 and R2. Namely, the document sheet D is moved at a fixed speed anywhere in the document feeding device. Such motion with constant velocity of the document sheet can readily be accomplished by synchronizing with the timing pulses issued from the timing pulse generating means 69.

In the drawings, reference symbols S1, S2 and S3 denote an empty sensor, a size discriminating sensor, and a document discharge sensor, respectively.

The empty sensor S1 is mounted at the entrance of the document supply passage R1 for ascertaining whether or not the document sheet D is present in the document supply tray 52.

The size discriminating sensor S2 is disposed between the document supply roller 25 and the skew correction roller 26 for detecting the leading end and rear end of the document sheet D being fed along the document supply passage R1. From time difference from detecting the leading end of the document sheet D to detecting the rear end of the same, it is possible to discriminate whether the document sheet being fed is large or small in longitudinal size. That is, the elapsed time (document passing time) in which the document sheet passes through the sensor S2 represents the longitudinal size (length in the document feeding direction) of the document sheet.

The document discharge sensor S3 is disposed near the entrance of the document discharge passage R3 in the document discharge means 40 for detecting the leading end and rear end of the document sheet D fed out from the document processing passage R2.

In the illustrated embodiment, the platen cover unit 50 has a document retaining means 56 including a document guide pad 56*a* substantially parallel to the platen P, and a push means 56*b* for permitting the guide pad 56*a* to be pressed against or separated from the platen P. The document guide pad 56*a* is usually separated from the platen P to allow the document sheet D to enter into between the guide pad 56*a* and the platen P.

The push means 56*b* is adapted to force down the guide pad 56*a* in order to bring the document sheet D in close contact with the platen P. However, since optical systems incorporated in ordinary copying machines generally have sufficient depth of focus, the document sheet D is not necessarily be close contacted with the platen P. If the gap between the platen P and guide pad 56*a* is sufficiently small, there is no need for the push means 56*b*.

The document supply tray 52 on the platen cover unit 50 has a collapsible auxiliary tray plate 58 for stably supporting the large-size document sheets.

Now the manner in which the document sheets of different sizes are selectively fed to the desired reading area by use of the automatic document feeding device of the aforenoted description will be described.

Figure 2:
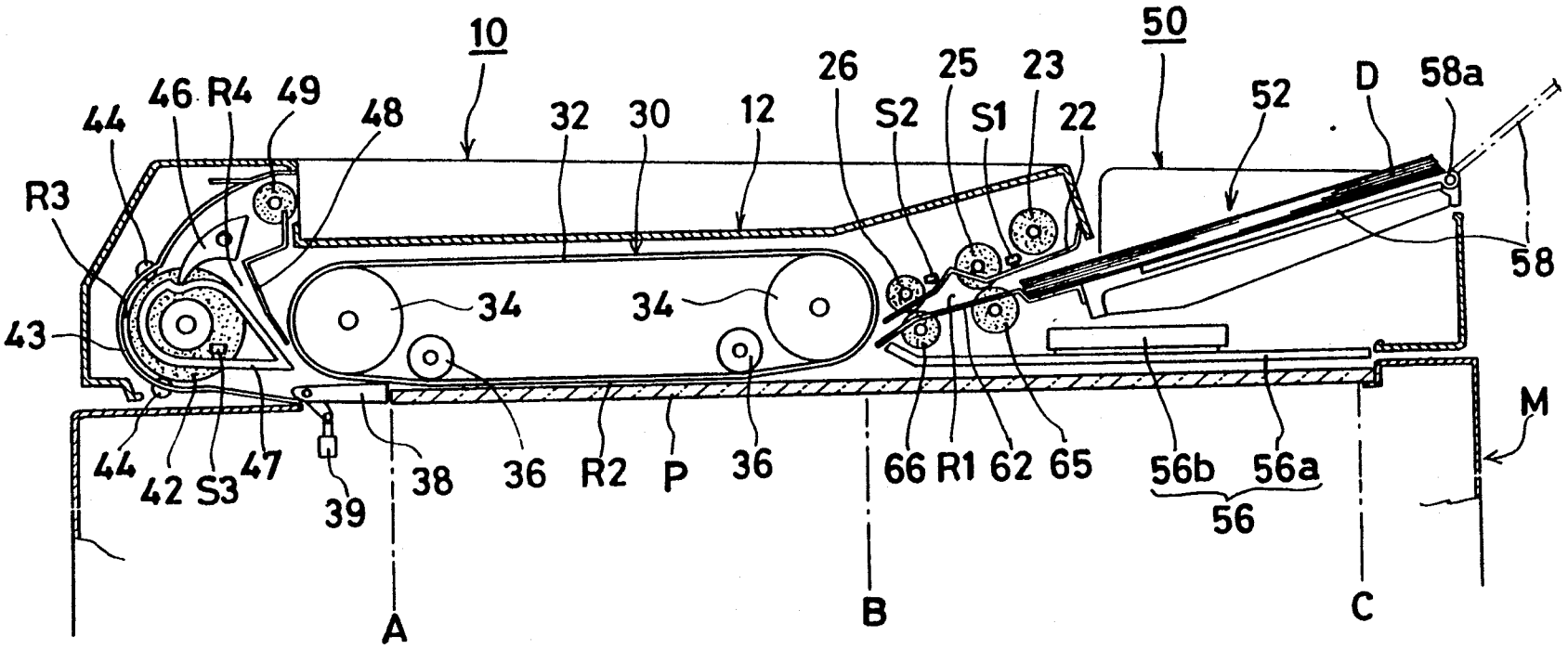

FIGS. 4(A) through 4(C) show the case in which the document sheets of relatively small size such as A4 size and ledger size are handled. The state in which the small-size document sheets are stacked on the document supply tray 52 is illustrated in FIG. 2. When giving a copying order to the copying machine, upon confirming the existence of the document sheet on the document supply tray 52 by means of the empty sensor S1, the pickup rollers 23 move downward while in rotation and then touch the uppermost document sheet of the stacked document sheets on the tray 52. Thus, only the uppermost document sheet D is drawn from the tray 52 and introduced into the document supply passage R1 between the document supply rollers 25 and the separation rollers 65. The document sheet D is fed forward by the document supply rollers 25 rotating forwardly. Though the separation rollers 65 rotate in the reverse-feeding direction, the uppermost document sheet D of the stacked document sheets on the tray 52 is infallibly forwarded because the separation rollers 65 are somewhat smaller in frictional coefficient than the document supply rollers 25. However, if two document sheets accidentally come into between the document supply rollers 25 and the separation rollers 65, only the uppermost document sheet is permitted to pass, but the second document sheet is forced back by the separation rollers 65. Thus, the so-called double feed can be prevented.

After the document sheet D thus introduced into the document supply passage R1 is detected by the size discriminating sensor S2, the skew correction rollers 26, 66 start to rotate with a fixed time delay. To be more specific, the document sheet D forwarded by the document supply rollers 25 passes through the size discriminating sensor S2 and collides with the skew correction rollers 26, 66 being at a stop. As a result, the document sheet D is slightly bent to thereby bring the leading end thereof in parallel touch with the contact portion of the opposed skew correction rollers 26, 66. Then, the skew correction rollers 26, 66 start to rotate immediately after the document sheet D collides with these rollers, to thereby forward the document sheet D without skew.

The document sheet D which is forwarded through the document supply passage R1 in the manner as noted above is led to the entrance of the document processing passage R2 located near the center of the reading area T (point B) on the platen P as shown in FIG. 4(A). Then, the document sheet D is introduced into the document processing passage R2 by driving the document conveying means 30.

At the time that the rear end of the document sheet D while advancing in the passage R2 passes through the size discriminating sensor S2, the size (length in the feeding direction) of the document sheet D is determined. That is to say, since the skew correction rollers 26, 66 and document conveying means 30 are synchronously driven with the fixed speed in conformity with the timing pulses issued from the timing pulse generating means 69, the document sheet can be deemed to be a small size when, after detecting the leading end of the document sheet D by the sensor S2, the rear end of the sheet D is detected in the time which it takes to move a small-size document sheet from the point B to the point A. Incidentally, the document sheet D shown in FIG. 4(B) should be determined to a small size.

In the case of the document sheet of small size, the document conveying means 30 is stopped when the prescribed time lapses after the leading end of the document sheet D passes through the sensor S2. At that time, the stopper 38 is actuated to raise so as to exactly stop the leading end of the document sheet D at the reference point A. Then, the desired copying operation is carried out.

Upon completion of copying, the stopper 38 is deactivated, and simultaneously, the document conveying means 30 is operated to feed forward the document sheet D from the reading area between the points A-B. The document sheet D thus fed out from the passage R2 is discharged through the document discharge passage R3 to the document output tray 12 by operating the document discharge means 40 composed of the document discharge roller 42 and the exit rollers 49, as shown in FIG. 4(C).

In the case of continuously feeding the subsequent document sheets, while discharging the preceding document sheet as shown in FIG. 4(C), the next document sheet may be concurrently introduced into the document processing passage R2 as shown in FIG. 4(B).

Next, the manner in which the document sheet of larger size than the length A-B of the reading area T on the platen is automatically supplied will be described with reference to FIGS. 5 (A) through 5 (D).

First, the document sheet D is led into the document processing passage R2 in the same manner as illustrated in FIG. 2 and FIG. 4(A), and then, forwarded along the passage R2 as shown in FIG. 5(A).

In the case when the rear end of the document sheet D is not detected by the size discriminating sensor S2 though the leading end of the sheet passes through the reference point A, the document sheet D is determined to a large size. Then, the sheet D is further forwarded until the prescribed time lapses after the rear end of the sheet passes through the sensor s2. When the rear end of the sheet D enters into the entrance of the document processing passage R2, the document conveying means 30 is reversed to feed the sheet D backward, as shown in FIG. 5(B), so as to permit the rear half of the sheet to enter into between the document guide pad 56*a* and the platen P, until the leading end of the sheet D arrives on the reference point A.

When the leading end of the sheet D moving backward on the platen reaches the reference point, the document conveying means 30 is stopped, so that the large-size document sheet D is positioned in the reading area T and pressed against the platen P by the document retaining means, as illustrated in FIG. 5(C). Then, copying is practiced.

After copying, the document sheet D is discharged to the document output tray 12 through the document discharge passage R3 by driving forward the document conveying means 30, document discharge roller 42 and exit rollers 49, as shown in FIG. 5(D).

As described above, the document sheets of large size can effectively be handled by the document feeding device designed primarily for feeding a small-size document sheet. Though the small size is designated to substantially half the large size occupying the reading area T (A-C) in the foregoing embodiment, the small size may of course be determined to less than half the large size, even one-third size.

The document sheet D being fed out from the document processing passage R2 after copying can be turned upside down and led again into the document processing passage through the return passage R4 around the document discharge roller 42 for the purpose of duplex copying, as shown in FIG. 6.

When turning the document sheet D, the turn gate 46 is alternatively switched to close the passage extending to the document output tray 12 and allow the document discharge passage R3 to communicate with the return passage R4. Thus, the document sheet D fed out from the passage R2 is advanced through the joined passages R3, R4 and turned upside down. Thereafter, the document sheet D led into the document processing passage R2 is copied, and then, discharged forward from the passage R2 to the output tray 12 by driving forward the document conveying means 30, document discharge roller 42, and exit rollers 49.

As described in detail above, the present invention makes it possible to automatically feeding document sheets of different sizes by use of a compact document feeder unit which is designed primarily for handling document sheets of relatively small size. According to the device of this invention, the document sheets of any size can be exactly fed to the prescribed location in an image processing machine such as a copying machine with high efficiency, since the size of the document sheet can be detected precisely.

As many apparently widely different embodiments of this invention may be made without departing from the spirit and scope thereof, it is to be understood that the invention is not limited to the specific embodiments thereof except as defined in the appended claims.

What is claimed is:

1. An automatic document feeding device for feeding document sheets having a leading end and a rear end one by one in an image processing machine having a transparent platen on which a document reading area having a front end portion defining a reading reference point and a document exit, which comprises:

a document feeder unit disposed on the image processing machine for feeding and discharging the document sheet to and from the reading reference point of the document reading area, said document feeder unit being opposite to said platen and covering an area on said platen to form a document processing passage, a platen cover unit disposed on said image processing machine for retaining said document sheet on the platen so as to cover a remaining area on the platen other than the area covered by said document feeder unit, said document feeder unit and said platen cover unit being adjacent to each other on the platen to form a document entrance to said document processing passage, and at least one size discriminating sensor for detecting the document sheet being fed toward said document feeder unit and discriminating whether said document sheet is a small size or a large size, said document feeder unit operating, in response to whether said at least one sensor senses that said document sheet is of small size or of large size, so as to 1) forward the document sheet through said document processing passage until said leading end of said document sheet reaches said reading reference point and feed out therefrom after image processing when said document sheet is discriminated to be a small size or 2) feed forward the document sheet through said document processing passage until the rear end of the document sheet reaches said entrance of said document processing passage, move backward the document sheet until said leading end of the document sheet reaches said reading reference point, and discharge forward the document sheet from said document processing passage after the image processing when said document sheet is discriminated to be a large size.

* * * * *